US007562710B2

(12) United States Patent
Buchanan

(10) Patent No.: US 7,562,710 B2
(45) Date of Patent: Jul. 21, 2009

(54) METHOD AND A DEVICE FOR IN SITU FORMATION OF A SEAL IN AN ANNULUS IN A WELL

(75) Inventor: Alastair Buchanan, Stavanger (NO)

(73) Assignee: Triangle Technology AS, Stavanger (NO)

( * ) Notice: Subject to any disclaimer, the term of this patent is extended or adjusted under 35 U.S.C. 154(b) by 0 days.

(21) Appl. No.: 11/885,877

(22) PCT Filed: Mar. 13, 2006

(86) PCT No.: PCT/NO2006/000094

§ 371 (c)(1),
(2), (4) Date: Nov. 14, 2007

(87) PCT Pub. No.: WO2006/098634

PCT Pub. Date: Sep. 21, 2006

(65) Prior Publication Data

US 2008/0190612 A1 Aug. 14, 2008

(30) Foreign Application Priority Data

Mar. 14, 2005 (NO) ..... 20051322

(51) Int. Cl.
*E21B 33/13* (2006.01)

(52) U.S. Cl. ..... 166/288; 166/57

(58) Field of Classification Search ..... None
See application file for complete search history.

(56) References Cited

U.S. PATENT DOCUMENTS 2,363,269 A 11/1944 Schlumberger
3,275,077 A * 9/1966 Smith et al. ..... 166/288
4,024,916 A * 5/1977 Hartley et al. ..... 166/288
4,158,388 A 6/1979 Owen et al.

(Continued)

FOREIGN PATENT DOCUMENTS

WO WO 03/072905 A1 9/2003

*Primary Examiner*—Zakiya W Bates
*Assistant Examiner*—Angela M DiTrani
(74) *Attorney, Agent, or Firm*—Foley & Lardner LLP

(57) ABSTRACT

A method and a device for in situ formation of a seal (17) in a region (2) of an annulus (18) located around a pipe structure (4) in a well (18), in which the method comprises the following steps: (A) to convey a perforation device into the pipe structure (4) to a location vis-a-vis said region (2) of the annulus (16); (B) by means of the perforation device, to make at least one hole (13) through the pipe wall of the pipe structure (4) at said annulus region (2); (C) to force a liquid sealing material, which is capable of entering into solid state, through said hole (13) and further into the annulus region (2) for the filling thereof, where-upon the sealing material enters into solid state and forms said seal (17). The distinctive characteristic of the method is that step (C) thereof also comprises:—to choose a fusible, solid-state packer material (5) as raw material for said seal material;—to heat and melt at least a part of the solid-state packer material (5); and—subsequently, to force liquid packer material (5) into the annulus region (2) via the at least one hole (13) through said pipe wall, whereupon the liquid packer material (5) enters into solid state and forms said seal (17) in the annulus region (2).

22 Claims, 2 Drawing Sheets

U.S. PATENT DOCUMENTS 4,415,269 A 11/1983 Fraser
6,431,282 B1 8/2002 Bosma et al.
6,474,414 B1 * 11/2002 Gonzalez et al. ..... 166/277
6,828,531 B2 * 12/2004 Spencer ..... 219/635
6,923,263 B2 * 8/2005 Eden et al. ..... 166/288

* cited by examiner 16
28
11
14
2
15
13
21
12
4
4
10
10
27
27
9
3
3
6
7
8
26
29
29
31
30

METHOD AND A DEVICE FOR IN SITU FORMATION OF A SEAL IN AN ANNULUS IN A WELL

FIELD OF INVENTION

The invention concerns a method and a device for downhole formation of a pressure- and flow-preventive seal in an annulus of an underground well, for example a hydrocarbon well or an injection well. The invention involves technology within the field of remedial annulus seals or annulus packers for use in a well, and especially formation of such seals during the post-completion phase of a well, i.e. the phase when the well is already completed and is operational. Moreover, the invention advantageously may be used both in uncased, open well bores and in cased well bores.

BACKGROUND OF THE INVENTION

The invention results from problems and disadvantages associated with prior art concerning placement of remedial seals in annuli in a well after completion and during the operating phase thereof.

A well is normally composed of several casing strings of different diameters, and these are arranged within each other having annuli therebetween. The strings, which have successively decreasing diameters, extend down to different depths in the well. A casing string of this type may be fixedly cemented, wholly or partially, in its well bore. Alternatively, the casing string may be uncemented in the well bore, i.e. a so-called open hole completion. The latter variant is common in a reservoir section of a hydrocarbon well. In order to establish a flow connection with surrounding rocks, the casing may be provided with openings, for example holes or slots, prior to installation in the well, or the pipe may be perforated after installation. In a production well, this pipe is described as production tubing. The casing may also be provided with one or more filters, for example sand screens, in order to filter out formation particles from a formation fluid before it flows into the well. Furthermore, the casing may be provided with a so-called gravel pack, for example sand or similar, between said filters and the surrounding rocks.

In addition, various well packers are used to isolate zones, for example one or more reservoir zones, along a well pipe, i.e. a casing with or without said filter, in a well. Packers of this type are normally placed on the outside of the specific well pipe and before it is conveyed into the well. This type of packer is commonly referred to as an external casing packer—"ECP". When the well pipe has been conveyed and positioned at the corrected location in the well, the packer(s) is/are activated in the annulus around the well pipe and is/are forced against surrounding rocks or a surrounding well pipe. Activation of such a packer may be carried out hydraulically, mechanically or by means of a swell packer that will expand upon contact with, for example, oil in the well. Packer setting techniques of this type constitute prior art.

During the post-completion phase of a well, particularly in connection with recovery of hydrocarbons from a reservoir, production-related problems or conditions may arise that necessitate or generate a need for installing one or more further annulus packers in the well. Installation of such remedial annulus packers may form part of an appropriate production management and reservoir drainage strategy, or the installation may be carried out in order to remedy an acute situation in the well. Accordingly, a need may exist for isolating one or more zones both in a production well and in an injection well, and the need may arise at any time throughout the lifetime of a well. The need will normally be greatest in horizontal wells and highly deviated wells. Deficient or failing zone isolation may restrain or prevent various efforts to stimulate the recovery from a well, which may reduce the recovery factor and profitability of the well and/or the reservoir. Insufficient zone isolation may also lead to unfortunate and/or dangerous conditions in the well.

The following examples point out some well conditions in which effective and selective annulus sealing may be of great significance to the performance of a well:

- Blocking of undesirable fluid flows, for example a water flow, from specific zones/intervals and into a production well, such as undesirable fluid flows from faults, fractures and highly permeable regions of surrounding rocks;
- Blocking of undesirable fluid flows to so-called "thief-zones" in an injection well, such as undesirable fluid flows to faults, fractures and highly permeable regions of surrounding rocks; and
- Selective placement of well treatment chemicals, including scale inhibitors and stimulation chemicals, in individual zones of a production well or injection well.

BRIEF SUMMARY OF THE INVENTION

Use of said external casing packers ("ECP's") and said gravel pack constitute the two main techniques employed for zone isolation of annuli, particularly in open well bores. The methods may be used individually or in combination, and the purpose thereof is to seal an annulus completely (external casing packers) or to significantly restrict a fluid flow in the annulus (gravel pack). The use and/or efficiency of these known techniques, however, is/are affected by several factors.

Arranging a completion string, for example, with external casing packers and/or gravel packs implies increased operational complexity and further completion costs for a well. The same applies to a downhole gravel packing operation. If no special zone isolation requirements are envisaged for a well, most likely the well will not be completed with gravel packs and/or extra external casing packers. Accordingly, the well will not be completed with regard to potential future zone isolation requirements. Prior art zone isolation thus lack the operational flexibility that is desirable during the well's operating phase after completion.

Even in the event that special zone isolation requirements are envisaged, and that further external casing packers therefore are mounted on the outside of the completion string, such casing packers may still have a non-optimum placement along the string relative to the zone isolation requirements that may arise after completion of the well. Placement of such packers is planned and is based on assumptions and estimates with respect to which future isolation requirements that may arise, and which annulus zones therefore must be isolated. It is not uncommon, however, to experience that the assumed isolation requirements do not agree with the actual isolation requirements that may arise in the well's operating phase. For this reason it is not uncommon that a need may arise in the operating phase for placing further annulus seals in the well.

An external casing packer, such as an inflatable casing packer, may also fail while being set or after being set in the well's annulus, whereby the annulus is sealed unsatisfactorily. The casing packer may fail due to an erroneous setting function and/or setting procedure. In an open well bore, it may also have an unsatisfactory sealing function if the geometric shape of the well's wall is enlarged beyond the outer dimension of the packer, such as in a washed out well bore.

During a downhole gravel packing operation, in which an annulus is gravel packed in situ, it is relatively common to experience that one or more axial and/or peripheral portions of the annulus unintentionally become filled incompletely with gravel pack material. This is most prevalent in highly deviated wells and horizontal wells. Such an incomplete filling reduces the function and efficiency of the gravel pack in the well.

Employment of external casing packers and gravel packs, however, is carried out before or during completion of the well. In order to form a remedial annulus seal in a well after being completed, it is most common in the art to perform a so-called squeeze cementing, in which a suitable cement slurry is forced into a well annulus via openings in a pipe structure. Alternatively, a suitable gel may be forced into the well annulus. The openings in the pipe structure may, for example, be perforations or slots in a casing, or filter openings in a sand screen, etc. In order to transport cement slurry or gel to a desirable location in the well, a pipe string, for example coiled tubing, is typically used. At least one so-called straddle packer is also typically used in this connection in order to define at least one injection zone in the well for injection of said cement slurry or gel.

U.S. Pat. No. 4,158,388 describes a method and a device for performing squeeze cementing in a well annulus, in which the device comprises, among other things, a perforation tool for making a hole in a well pipe. During the squeeze cementing operation, the device is attached to a pipe connection to the surface for supply of cement slurry.

Remedial annulus sealing by means of a suitable cement slurry or gel is encumbered with a series of problems and disadvantages. Some of these are associated with properties of the liquid to be injected into said annulus. This injection liquid must possess sufficiently good flow properties (rheological properties) and setting properties for allowing it to be pumped down into the well, and then to be set as a seal in the annulus thereafter. It has thus proven difficult to obtain injection liquids possessing optimum liquid characteristics both with respect to flow properties and setting properties. In practice, non-optimum injection liquids therefore are used, in which one or more liquid properties are prioritised at the expense of other liquid properties. This imbalance may, among other thing, lead to a undesirable and unfortunate mixing of different fluids in the annulus, which causes dilution and/or contamination of the annulus seal and also subsequent inadequate seal distribution and/or seal quality. Said imbalance may also cause an unfavourable setting time for the injection liquid. Yet further, a liquid injection process of this type also requires a thorough control of injection volume and placement of the injection liquid in the annulus, which may be difficult to carry out with sufficient precision to achieve a good result. Inadequate control in this connection may also lead to unfavourable injection liquid contamination due to undesirable mixing with other fluids in the annulus, and/or it may have unfortunate effects on surrounding rocks. Such a liquid injection process also implies increased operational complexity and further costs for a well, especially in connection with underwater operations offshore.

Yet further, U.S. Pat. No. 4,415,269 describes a device for forming a reinforced foam lining in an open well bore, insofar as the foam lining is to cover a permeable wall zone of the well bore. Upon introduction in the well, the device contains liquid foam and catalyst placed each in a chamber. In position of use down in the well, foam and catalyst is mixed to form expandable two-component foam that is forced out of the device. The two-component foam then is injected into openings in a perforated pipe previously attached covering said wall zone in the well. Expanding foam will thus fill and flow through the perforations in the pipe. Thereafter the foam will harden and form said reinforced foam lining against the wall of the well. As such, U.S. Pat. No. 4,415,269 describes a precompletion technique. Although some features of the device according to U.S. Pat. No. 4,415,269 resemble those of the present invention, the device is not suitable for forming remedial annulus seals in a well.

Due to said problems and disadvantages associated with prior art in this field, there is great interest in obtaining technical solutions that render placement of remedial annulus seals in a well simpler and less costly, especially during the operating phase after completion.

The primary object of the invention is to avoid or reduce the above-mentioned disadvantages of prior art.

More specifically, the object of the invention is to provide a technical solution for forming at least one remedial, pressure- and flow-preventive and reliable seal in an annulus of a well.

According to a first aspect of the invention, a method for in situ formation of a seal in a region of an annulus located around a pipe structure in a well is provided. For example, the pipe structure may consist of a well pipe or a sand screen or similar in the well. The method comprises the following steps:

(A) to convey a perforation device into the pipe structure to a location vis-à-vis said region of the annulus;

(B) by means of the perforation device, to make at least one hole through the pipe wall of the pipe structure at said annulus region;

(C) to force a liquid sealing material, which is capable of entering into solid state, through said hole and further into the annulus region for the filling thereof, whereupon the sealing material enters into solid state and forms said seal. The distinctive characteristic of the method is that step (C) thereof also comprises:

- to choose a fusible, solid-state packer material as raw material for said seal material;
- to heat and melt at least a part of the solid-state packer material; and
- subsequently, to force liquid packer material into the annulus region via the at least one hole through said pipe wall, whereupon the liquid packer material enters into solid state and forms said seal in the annulus region.

Several types of material that may be used for said fusible, solid-state packer material exist on the market. Although no specific trademark names are disclosed herein, these material types exist under different trademark names on the market. Generally speaking, thermoplastic elastomers ("TPE") and thermoplastic vulcanizates ("TPV") will be suitable candidates for such a packer material. Within thermoplastic elastomers, thermoplastic polyurethane ("TPU"), including polyether-based urethane rubber, is well suited as packer material in this connection. Ethylene-ChloroTriFluoro-Ethylene ("ECTFE"), which is a copolymer of ethylene and chlorotrifluoroethylene, is also suitable as such a thermoplastic packer material.

Said perforation device for making holes through the pipe wall of the pipe structure may consist of a drilling device, a punching implement, a perforation tool or similar. For example, the perforation tool may be a perforation gun containing an explosive charge for making the hole in the pipe wall.

In a preferred embodiment, the method also comprises to choose a fusible, solid-state packer material that, after forming said seal in the annulus region, is capable of swelling when coming into contact with the particular fluid in the annulus region. Such an annulus packer will thus be able to swell and expand radially outwards and seal against a surrounding pipe wall or bore hole wall. Naturally, a packer material capable of swelling when in contact with the specific fluid in the annulus region must be chosen. Some of said thermoplastic packer materials are also suitable for this purpose. For example, the fluid may consist of water, oil, gas, drilling liquid and/or a completion liquid. Depending on the specific requirement(s), the swelling and expansion of the set packer may take place over a short or a long time, for example hours, days, weeks or years.

In a first variant of the method, liquid packer material is conducted via a suitable transfer conduit into the well and onwards to said hole through the pipe wall. Such a transfer conduit may comprise a pipe, for example coiled tubing, or a flexible hose or conduit suitable for this purpose.

A second variant of the method, however, comprises the following steps:

- to use a packer injection module in order to force liquid packer material into said annulus region, wherein the packer injection module at least comprises the following components:
  - at least one packer chamber containing fusible packer material;
  - a heating device; and
  - a driving device;
- by means of a suitable connection line, to convey the packer injection module into the pipe structure to said location vis-à-vis the annulus region;
- by means of said heating device, to keep at least a part of the packer material in a melted, liquid state in the packer chamber;
- to connect said packer chamber in a flow-communicating manner to said hole through the pipe wall; and
- by means of said driving device, to force melted, liquid packer material out of the packer chamber and further into the annulus region via said hole through the pipe wall.

In one embodiment of this second variant of the method, at least a part of the solid-state packer material is heated and melted before the packer injection module is conveyed to said location vis-à-vis the annulus region. In so doing, the packer material is kept in a melted, liquid state in the packer chamber by means of said heating device. This is because some thermoplastic packer materials are available in granulate form and have high thermal insulation ability, thereby requiring a relatively large amount of energy and a long time to melt. It may therefore be advantageous to start the heating and melting before the packer injection module has been conveyed to the particular location in the well.

In another embodiment of the second variant of the method, the packer injection module is conveyed into the pipe structure containing at least one packer chamber with solid-state packer material. In this connection, said heating device is used to heat and melt at least a part of the solid-state packer material after said packer chamber has been connected in a flow-communicating manner to said hole through the pipe wall.

Said connection line may comprise a pipe, for example coiled tubing, and/or a flexible cable, for example an electric cable. As such, this connection line may be arranged in a manner allowing it to transmit energy and control signals to said packer injection module, for example via a control module associated with the packer injection module and distributing energy and control signals thereto.

According to said second variant, the method may further comprise:

- to connect the packer injection module in a flow-communicating manner to a flow-through connection module comprising said perforation device; and
- to connect said connection module in a flow-communicating manner to said hole through the pipe wall, whereby the connection module forms a flow connection between the packer injection module and said hole.

The second variant of the method may also comprise:

- to use a driving device comprising at least one piston arranged axially movable in said packer chamber, the packer chamber thus forming a piston chamber; and
- to conduct a fluid into the packer chamber and drive the piston against the packer material and thereby drive liquid packer material out of the packer chamber.

As an alternative to the preceding embodiment, the method may comprise:

- to use a packer injection module comprising the following components:
  - a two-part packer chamber provided with solid-state packer material in one chamber part, and an associated curing catalyst in the other chamber part;
  - a driving device comprising a two-part piston arranged axially movable in the two-part packer chamber and having one piston part in each chamber part thereof; and
  - a mixing device arranged downstream of the packer chamber;
- to conduct a fluid into the two-part packer chamber and drive the two-part piston against both the packer material and the curing catalyst; and
- to conduct liquid packer material and curing catalyst into the mixing device for mixing thereof, whereupon the mixture is forced into the annulus region via said hole through the pipe wall.

As a further alternative to said second variant, the method may comprise:

- to use a driving device comprising a auger conveyor arranged rotatably in the packer chamber; and
- to rotate the auger conveyor and thereby drive liquid packer material out of the packer chamber.

According to the method the packer injection module may also be connected to a well tractor that is conveyed into said pipe structure by means of a connection line, for example of the type mentioned above. Such a well tractor is typically used for wells having a deviation angle from vertical being more than 65-70 degrees, for example horizontal well.

According to a second aspect of the invention, a device for in situ formation of a seal in a region of an annulus located around a pipe structure in a well is provided. As mentioned, the pipe structure may comprise a well pipe or a sand screen or similar in the well. The seal is formed by forcing a liquid sealing material, which is capable of entering into solid state, through at least one hole through said pipe wall of the pipe structure and further into said annulus region. The device is arranged in a manner allowing it to be conveyed into the pipe structure by means of a connection line, for example coiled tubing and/or a flexible cable. The distinctive characteristic of the device is that it comprises a packer injection module for forcing liquid packer material into said annulus region in order to enter into solid state and form said seal therein. The packer injection module comprises at least the following components:

- at least one packer chamber containing a fusible packer material as raw material for said seal material;
- a heating device for the packer material;
- a driving device for driving melted, liquid packer material out of said packer chamber; and a coupling means for connecting the packer chamber in a flow-communicating manner to said hole through the pipe wall, thus rendering possible to conduct liquid packer material further into said annulus region.

In a preferred embodiment of the device, said packer chamber may contain a fusible packer material that, after forming said seal in the annulus region, is capable of swelling when coming into contact with the particular fluid in the annulus region.

In one embodiment, the packer chamber may contain a melted, liquid packer material, wherein the packer material is kept in a melted, liquid state by means of said heating device. As mentioned, this may be advantageous when using some thermoplastic packer materials that require a relatively large amount of energy and a long time to melt. Thereby the heating and melting may start before the packer injection module is conveyed to the specific location in the well.

In another embodiment, the packer chamber may contain a fusible, solid-state packer material. In this connection, said heating device is used to heat and melt at least a part of the solid-state packer material after having connected said packer chamber in a flow-communicating manner to said hole through the pipe wall.

Advantageously, said connection line may be arranged in a manner allowing it to transmit energy and control signals to the packer injection module, for example via a control module associated with the packer injection module and arranged in a manner allowing it to distribute energy and control signals thereto.

In one embodiment of the device, the packer injection module may be connected in a flow-communicating manner to a flow-through connection module comprising a perforation device for making said hole through the pipe wall, wherein said connection module is arranged in a manner allowing it to be connected in a flow-communicating manner to said hole through the pipe wall. Thereby the connection module forms a flow connection between the packer injection module and said hole through the pipe wall.

In one embodiment variant, said driving device in the packer injection module may comprise at least one piston arranged axially movable in said packer chamber, the packer chamber thus forming a piston chamber. Thereby the piston is arranged in a manner allowing it to be driven against the packer material by conducting a fluid into the packer chamber and thereby driving liquid packer material out of the packer chamber.

In an alternative embodiment variant, the packer injection module may comprise the following components:

a two-part packer chamber provided with solid-state packer material in one chamber part, and an associated curing catalyst in the other chamber part;

a driving device comprising a two-part piston arranged axially movable in the two-part packer chamber and having one piston part arranged in each chamber part thereof; and a mixing device arranged downstream of the packer chamber. Thereby the two-part piston is arranged in a manner allowing it to be driven against both the packer material and the curing catalyst by conducting a fluid into the two-part packer chamber, thus rendering possible to conduct liquid packer material and curing catalyst into the mixing device for mixing thereof. Then the mixture may be forced into said annulus region.

In a further alternative embodiment variant, said driving device may comprise a auger conveyor arranged rotatably in the packer chamber. Thereby the auger conveyor is arranged in a manner allowing it to drive liquid packer material out of the packer chamber by rotating the auger conveyor.

The packer injection module may also be connected to a well tractor arranged in a manner allowing it to be conveyed into said pipe structure by means of a connection line.

BRIEF DESCRIPTION OF THE DRAWINGS

Non-limiting examples of embodiments of the present invention will be described hereinafter, referring to the following figures, in which:

FIGS. 4-6 show, in larger scale, a longitudinal section through a packer injection module and an associated connection module of the present device, in which FIGS. 4 and 5 show alternative embodiments of a driving device in the packer injection module, whereas FIG. 6 shows details of the connection module.

The figures are schematic and distorted with respect to components' shape, richness of detail, relative dimensions and relative positions with respect to one another. In the following, like or corresponding components and/or details of the figures will be denoted with the same reference numerals.

DETAILED DESCRIPTION OF EXEMPLARY EMBODIMENTS OF THE INVENTION

Figure 1:
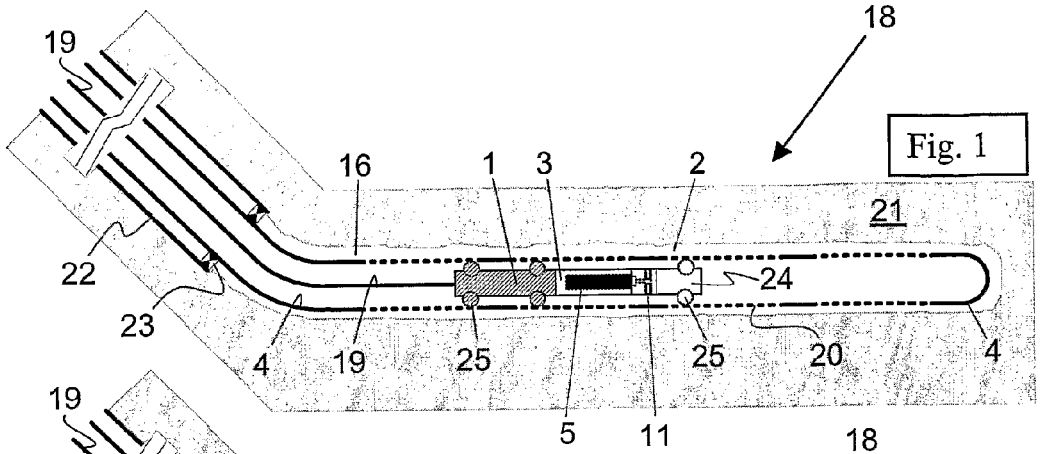
FIGS. 1-3 show a longitudinal section through a horizontal portion of a production well whilst a well tractor provided with a device according to the invention is located in the horizontal portion in order to form an annulus seal between a production tubing and surrounding rocks, insofar as FIGS. 1-3 illustrate three successive operational steps related to this.
Figure 2:
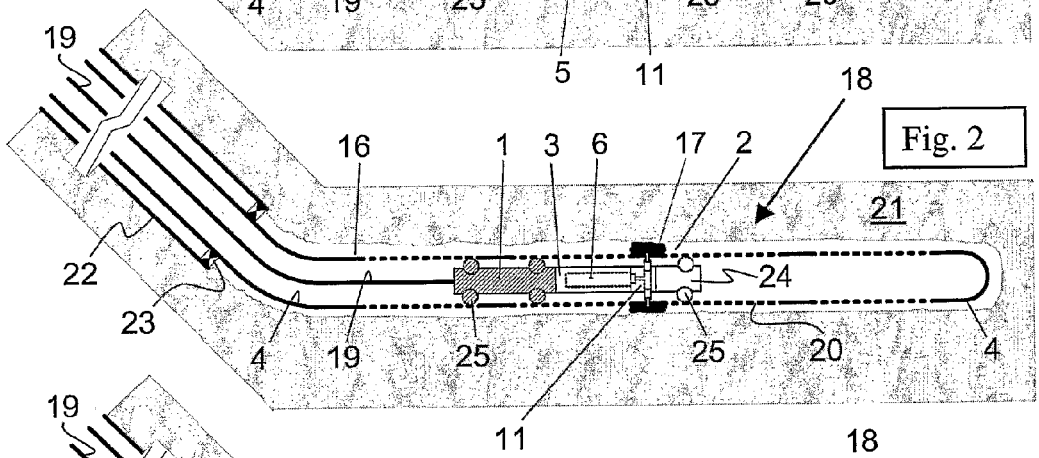
Figure 3:
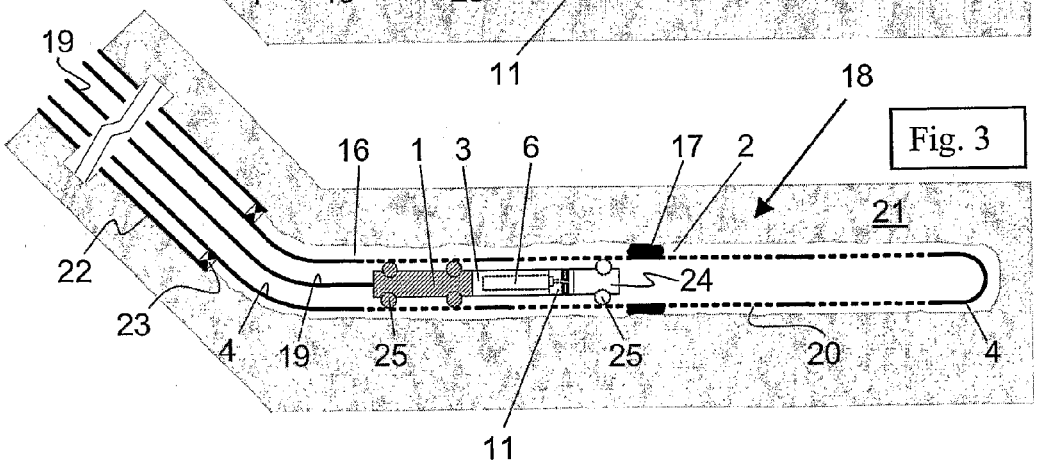

FIGS. 1-3 show a well tractor 1 located in a production tubing 4 through an open hole completed horizontal portion of a production well 18. Well tractors constitute prior art and are therefore not described in further detail herein. Along said horizontal portion, the production tubing 4 is provided with inflow openings 20 that, via an intermediate annulus 16, connect the production tubing 4 in a flow-communicating manner with permeable rocks in a surrounding reservoir 21. Above said horizontal portion, a casing 22 and a so-called guide shoe 23 at the bottom thereof surround the production tubing 4.

The uppermost side of the well tractor 1 is connected to surface via a connection line 19, which in this example is comprised of an electric cable. The electric cable 19 is arranged in a manner allowing it to transmit energy and control signals to both the well tractor 1 and a device according to the invention being connected to the lowermost side of the well tractor 1. Energy and control signals are transmitted via a control module (not shown) associated with the device and distributing energy and control signals thereto. In this context, "upper, uppermost" and "lower, lowermost" refer to a shallower reference point in the production well 18, normally sea level, in which the distance from said reference point is measured along the well path.

In the embodiment according to FIGS. 1-3, the present device comprises both a packer injection module 3 and a flow-through connection module 11 arranged below the injection module 3. The lower end of the connection module 11 is connected to a movable guide section 24, which forms a protective and stabilizing lower end of the well tractor assembly 1, 3, 11, 24. The guide section 24, like the well tractor 1, is provided with external wheels 25 in order for the tractor assembly 1, 3, 11, 24 to be able move in the well 18.

The flow-through connection module 11 comprises a telescopic, flow-through and radially movable drilling device 14 (cf. FIG. 6) to be able to make holes 13 through the tubing wall of the production tubing 4. As an alternative (not shown) to the drilling device 14, for example a punching implement or similar may be used for the same purpose.

Figures 4, 5, 6:
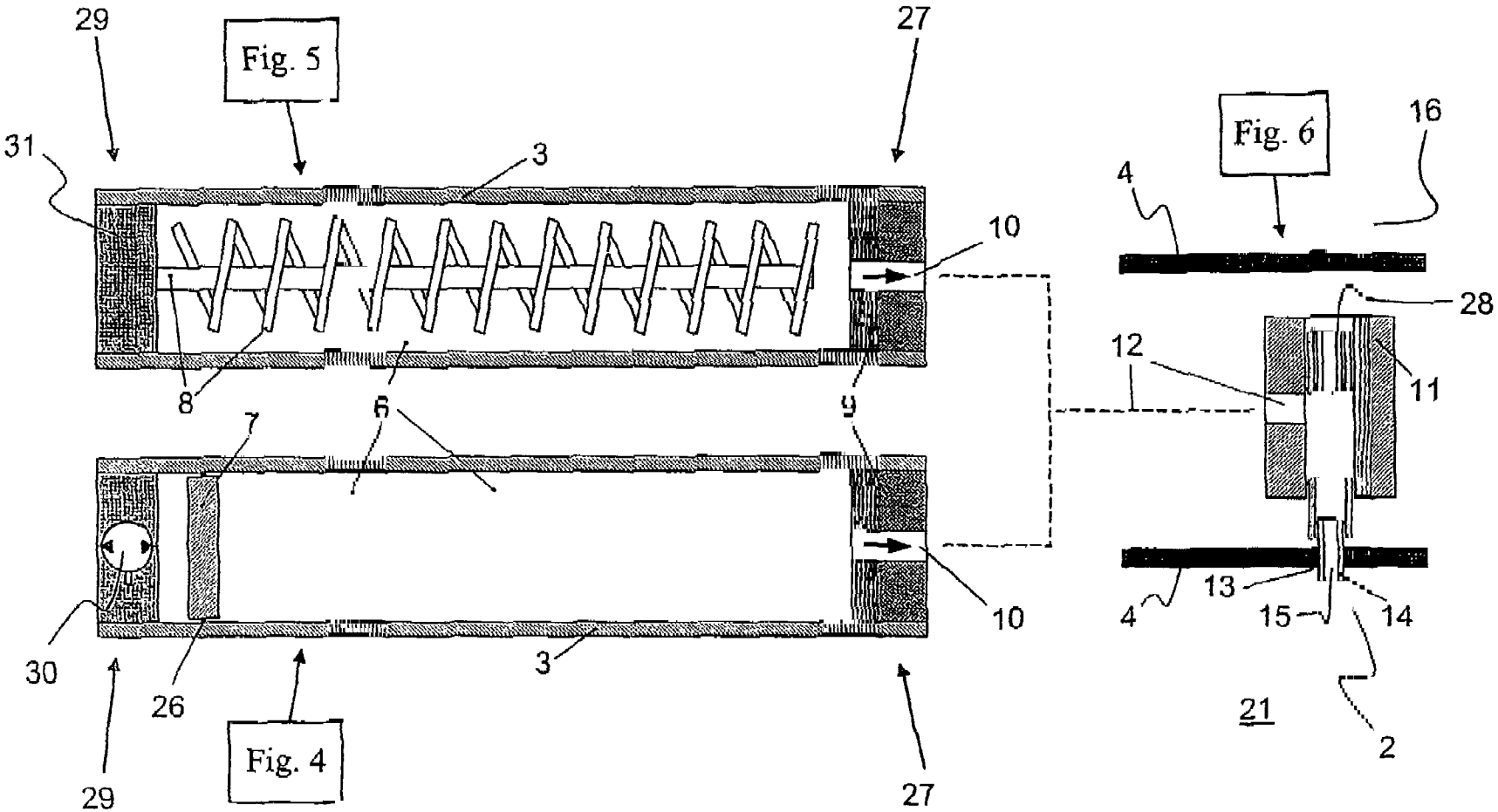

Moreover, the packer injection module 3 comprises at least a packer chamber 6 containing fusible, solid-state packer material 5, a heating device 9 (not shown in FIGS. 1-3), and a driving device 7 or 8 (not shown in FIGS. 1-3). Further details of the connection module 11 and the packer injection module 3 are shown in FIGS. 4-6.

FIG. 1 shows an operational step, in which the tractor assembly 1, 3, 11, 24 is on its way into the production tubing 4 in order to form a remedial seal 17 in a region 2 of said annulus 16. In this operational step, the packer chamber 6 is filled with solid-state packer material 5.

FIG. 2 shows a subsequent operational step, in which liquid packer material 5 just has been injected into and distributed within said annulus region 2, thereby having established said seal 17 in the annulus 16. Prior to this, the drilling device 14 of the connection module 11 has drilled a hole 13 through the tubing wall of the production tubing 4, and the connection module 11 is connected in a flow-communicating manner to the hole 13. The connection module 11 thus forms a flow connection between the packer injection module 3 and the hole 13 in the tubing wall. Prior to carrying out the injection, said solid-state packer material 5 has been heated and melted by means of said heating device 9. Then liquid packer material 5 has been driven out of the packer chamber 6, via the connection module 11 and further into the hole 13 in the tubing wall by means of said driving device 7 or 8.

FIG. 3 shows a further subsequent operational step, in which the tractor assembly 1, 3, 11, 24 is on its way out of the production tubing 4 after having formed the remedial seal 17 in the annulus 16.

FIGS. 4-6 show the present device in a position of use corresponding to the operational step illustrated in FIG. 2, i.e. after having emptied the packer material 5 from the packer chamber 6. FIGS. 4 and 5 show alternative examples of embodiments of the driving device for packer material 5 of the packer injection module 3, whereas FIG. 6 shows the connection module 11 when connected to the hole 13 in the tubing wall of the production tubing 4.

In both alternative examples of embodiments, a downstream end 27 of the packer injection module 3 is provided with said heating device 9 in order to melt solid-state packer material 5 located in the packer chamber 6. By means of said driving device, melted and liquid packer material 5 may be driven out of the packer chamber 6 via a discharge channel 10 in the downstream end 27 of the packer injection module 3. The discharge direction of the packer material 5 is depicted with downstream-directed arrows in FIGS. 4 and 5. As indicated with a dash line in FIGS. 4-6, the discharge channel 10 of the packer chamber 6 is connected in a flow-communicating manner to the connection module 11 via flow-through channels 12 and an internal flow channel 15 in the telescopic drilling device 14 of the connection module 11. In FIG. 6, the drilling device 14 is shown connected to said hole 13 in the production tubing 4. The telescopic drilling device 14 is retracted radially back into the connection module 11 upon disconnection from the production tubing 4. Furthermore, an electric actuator 28 arranged in the connection module 11, and shown schematically in FIG. 6, drives the drilling device 14.

The embodiment according to FIG. 4 shows a cylindrical packer injection module 3 provided with a driving device in the form of a piston 7. The piston 7 is arranged axially movable within said packer chamber 6, and the piston 7 is provided with an external ring gasket 26 for sealing against the wall of the packer chamber 6. An upstream end 29 of the packer injection module 3 is provided with a schematically shown hydraulic pump 30 for conducting a suitable driving fluid into the packer chamber 6 and driving the piston 7 against the packer material 5 located within the chamber 6.

The embodiment according to FIG. 5, however, shows a cylindrical packer injection module 3 provided with a driving device in the form of a auger conveyor 8 arranged rotatably within the packer chamber 6. Upon conveying the packer injection module 3 into the well 18, solid-state packer material 5 encloses the auger conveyor 8. Liquid packer material 5, which has been melted by means of said heating device 9, is driven out of the packer chamber 6 by rotating the auger conveyor 8. Rotation of the auger conveyor 8 is carried out by means of an electric motor 31 arranged in said upstream end 29 of the packer injection module 3.

The invention claimed is:

1. A method for forming a seal in situ in a region of an annulus located around a pipe structure in a well, the method comprising:

(A) conveying a perforation device into the pipe structure to a location adjacent the region of the annulus;

(B) making at least one hole through a pipe wall of the pipe structure at the annulus region using the perforation device;

(C) heating and melting at least part of a fusible, solid-state packer material capable of entering into a solid state upon cooling, and then forcing melted, liquid packer material through the hole through the pipe wall and further into the annulus region and filling the annulus region, wherein the liquid packer material, upon cooling, enters into solid state and forms the seal, the method further comprising:

using a packer injection module comprising at least one packer chamber containing the fusible packer material; a heating device; and a driving device and a propulsion device therefore;

conveying the packer injection module into the pipe structure to the location adjacent the annulus region using a connection line;

keeping at least part of the packer material in a melted, liquid state in the packer chamber using the heating device;

connecting the packer chamber in a flow-communicating manner to the hole through the pipe wall; and forcing melted, liquid packer material out of the packer chamber and into the annulus region through the hole through the pipe wall using the driving device and the propulsion device, wherein the seal forms upon cooling.

2. The method according to claim 1, further comprising:

heating and melting at least part of the solid-state packer material before conveying the packer injection module to the location adjacent the annulus region; and keeping the packer material in a melted, liquid state in the packer chamber using the heating device.

3. The method according to claim 1, further comprising:

conveying the packer injection module into the pipe structure containing at least one packer chamber with solid-state packer material; and using the heating device to heat and melt at least part of the solid-state packer material after connecting the packer chamber in a flow-communicating manner to the hole through the pipe wall.

4. The method according to claim 1, further comprising arranging the connection line in a manner allowing it to transmit energy and control signals to the packer injection module.

5. The method according to claim 1, further comprising: connecting the packer injection module in a flow-communicating manner to a flow-through connection module comprising the perforation device; and connecting the connection module in a flow-communicating manner to the hole through the pipe wall, whereby the connection module forms a flow connection between the packer injection module and the hole through the pipe wall.

6. The method according to claim 1, further comprising: using a propulsion device in the form of a hydraulic pump, and using a driving device comprising at least one piston arranged axially movable in the packer chamber, wherein the packer chamber forms a piston chamber; and conducting a fluid into the packer chamber using the pump and driving the piston against the packer material, thereby driving liquid packer material out of the packer chamber.

7. The method according to claim 1, further comprising: using a packer injection module comprising a two-part packer chamber provided with solid-state packer material in one chamber part and an associated curing catalyst in another chamber part; a propulsion device in the form of a hydraulic pump; a driving device comprising a two-part piston arranged axially movable in the two-part packer chamber and having one piston part in each chamber part of the packer chamber; and a mixing device arranged downstream of the packer chamber;

conducting a fluid into the two-part packer chamber using the pump and driving the two-part piston against both the packer material and the curing catalyst;

conducting liquid packer material and curing catalyst into the mixing device for mixing a mixture of liquid packer material and curing catalyst, and forcing the mixture of liquid packer material and curing catalyst into the annulus region via the hole through the pipe wall.

8. The method according to claim 1, further comprising: using a propulsion device in the form of an electric motor and a driving device comprising an auger conveyor arranged rotatably in the packer chamber; and rotating the auger conveyor using the electric motor, thereby driving liquid packer material out of the packer chamber.

9. The method according to claim 1, further comprising: connecting the packer injection module to a well tractor; and conveying the well tractor and the packer injection module into the pipe structure using the connection line.

10. The method according to claim 1, further comprising providing a thermoplastic elastomer or a thermoplastic vulcanizate as the fusible, solid-state packer material.

11. The method according to claim 10, further comprising choosing thermoplastic polyurethane as the fusible, solid-state packer material.

12. The method according to claim 10, further comprising choosing thermoplastic Ethylene-ChloroTriFluoro-Ethylene copolymer as the fusible, solid-state packer material.

13. A device for forming a seal in situ in a region of an annulus located around a pipe structure in a well, comprising: a packer injection module for forcing liquid packer material into the annulus region through at least one hole through a pipe wall of the pipe structure, wherein the packer injection module comprises:

at least one packer chamber containing fusible packer material;

a heating device configured to melt the fusible packer material;

a driving device and a propulsion device configured to force melted, liquid packer material out of the packer chamber; and a coupling device configured to connect the packer chamber in a flow-communicating manner to the hole through the pipe wall;

wherein the device is configured to force melted, fusible packer material capable of entering into a solid state upon cooling through the at least one hole through the pipe wall of the pipe structure and further into the annulus region to fill the annulus region, wherein the liquid packer material, upon cooling, enters into the solid state and forms the seal;

wherein the device is arranged in a manner allowing it to be conveyed into the pipe structure using a connection line.

14. The device according to claim 13, wherein the packer injection module is configured to receive energy and control signals from the connection line; and wherein the connection line is arranged in a manner allowing it to transmit energy and control signals to the packer injection module.

15. The device according to claim 13, wherein the packer injection module is connected in a flow-communicating manner to a flow-through connection module comprising a perforation device configured to make the hole through the pipe wall of the pipe structure; and wherein the connection module is configured in a manner allowing it to be connected in a flow-communicating manner to the hole through the pipe wall to form a flow connection between the packer injection module and the hole through the pipe wall.

16. The device according to claim 13, wherein the propulsion device for the driving device is a hydraulic pump;

wherein the driving device comprises at least one piston arranged axially movable in the packer chamber, wherein the packer chamber forms a piston chamber; and wherein the piston is configured to allow the piston to be driven against the packer material using the hydraulic pump to conduct a fluid into the packer chamber and to drive liquid packer material out of the packer chamber.

17. The device according to claim 13, wherein the packer injection module comprises:

a two-part packer chamber provided with solid-state packer material in one chamber part, and an associated curing catalyst in another chamber part;

a driving device comprising a two-part piston arranged axially movable in the two-part packer chamber and having one piston part arranged in each chamber part thereof;

a propulsion device in the form of a hydraulic pump for the driving device; and a mixing device arranged downstream of the packer chamber; and wherein the two-part piston is configured to allow the piston to be driven against both the packer material and the curing catalyst using the hydraulic pump to conduct a fluid into the two-part packer chamber so as to conduct liquid packer material and curing catalyst into the mixing device for mixing a mixture of liquid packer material and curing catalyst to be forced into the annulus region.

18. The device according to claim 13, wherein the propulsion device for the driving device is an electric motor;

wherein the driving device comprises an auger conveyor arranged rotatably in the packer chamber; and wherein the auger conveyor is configured to allow the auger conveyor to drive liquid packer material out of the packer chamber using the electric motor to rotate the auger conveyor.

19. The device according to claim 13, wherein the packer injection module is connected to a well tractor arranged in a manner allowing it to be conveyed into the pipe structure using the connection line.

20. The device according to claim 13, wherein the fusible packer material comprises a thermoplastic elastomer or a thermoplastic vulcanizate.

21. The device according to claim 20, wherein the fusible packer material comprises thermoplastic polyurethane.

22. The device according to claim 20, wherein the fusible packer material comprises thermoplastic Ethylene-ChloroTriFluoro-Ethylene copolymer.

* * * * *